US011453984B2

(12) United States Patent
Muir et al.

(10) Patent No.: US 11,453,984 B2
(45) Date of Patent: Sep. 27, 2022

(54) RECLAIMER HAVING A DRUM CHAMBER DOOR CONTROL SYSTEM

(71) Applicant: CATERPILLAR PAVING PRODUCTS INC., Brooklyn Park, MN (US)

(72) Inventors: Jason W. Muir, Andover, MN (US); Nathaniel S. Doy, Maple Grove, MN (US); Matthew S. Frantz, Eden Prairie, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 17/102,521

(22) Filed: Nov. 24, 2020

(65) Prior Publication Data

US 2022/0162815 A1 May 26, 2022

(51) Int. Cl.

| | |
|---|---|
| ***E01C 23/00*** | (2006.01) |
| ***E01C 23/088*** | (2006.01) |
| ***E01C 23/01*** | (2006.01) |
| ***E01C 23/12*** | (2006.01) |

(52) U.S. Cl.
CPC ..... *E01C 23/088* (2013.01); *E01C 23/01* (2013.01); *E01C 23/127* (2013.01)

(58) Field of Classification Search
CPC ..... E01C 23/088; E01C 23/127; E01C 23/01
See application file for complete search history.

(56) References Cited

U.S. PATENT DOCUMENTS

| | | | | |
|---|---|---|---|---|
| 5,354,147 | A * | 10/1994 | Swisher, Jr. | E01C 23/088 172/435 |
| 9,121,146 | B2 | 9/2015 | Paulsen et al. | |
| 9,797,100 | B1 * | 10/2017 | Muir | E01C 21/00 |
| 9,879,391 | B2 | 1/2018 | Berning et al. | |
| 10,000,898 | B2 | 6/2018 | Wachsmann | |
| 10,094,078 | B2 | 10/2018 | Husar | |
| 10,640,933 | B2 | 5/2020 | Payne et al. | |
| 2019/0127930 | A1 * | 5/2019 | Sondreal | E02F 3/183 |

* cited by examiner

*Primary Examiner* — Carib A Oquendo
(74) *Attorney, Agent, or Firm* — Finnegan, Henderson, Farabow, Garrett & Dunner LLP.

(57) ABSTRACT

A reclaimer has a frame and a plurality of wheels connected to the frame. The reclaimer has a drum chamber connected to the frame and including movable door. The reclaimer has a milling drum positioned within the drum chamber. The milling drum engages with a ground surface. The reclaimer has an engine that rotates the milling drum and propels the wheels such that material exits the drum chamber from under the movable door. Further, the reclaimer has a controller that determines a position of the movable door based on at least one of a machine characteristic and a predetermined gradation for the material exiting from the drum chamber, and selectively adjusts an actuator associated with the movable door based on the determined position.

20 Claims, 7 Drawing Sheets

RECLAIMER HAVING A DRUM CHAMBER DOOR CONTROL SYSTEM

TECHNICAL FIELD

The present disclosure relates generally to a reclaimer and, more particularly, to a reclaimer having a drum chamber door control system.

BACKGROUND

It is sometimes desirable to stabilize or reconstitute an upper layer of a worksite (e.g. parcel of land, parking lot, building site, etc.) before constructing a roadway or other structure on the worksite. This is usually accomplished by removing the upper layer of material from the worksite, mixing it with stabilizing components such as cement, ash, lime, etc., and depositing the mixture back on the worksite. A machine, such as a reclaimer, stabilizer, or rotary mixer is often used for this purpose. Such reclaimers typically include a frame supported by wheels or tracks and a milling drum attached to the frame. The milling drum is enclosed in a drum chamber. The cutting tools or teeth on the milling drum tear up the ground and remove material. The rotating milling drum also helps to mix the removed material with stabilizing ingredients and/or water. The reconstituted material then exits the drum chamber and is deposited back on to the ground surface, usually towards a rear of the drum chamber.

The drum chamber includes movable doors at the front and rear of the drum chamber. An operator of the reclaimer typically adjusts the amount of opening of the front and rear doors manually. The positions of the front and rear doors relative to the ground surface can be used to control the amount of mixing in the drum chamber and the gradation (e.g. graininess or particle size distribution) of the resulting mixture that is deposited on the ground surface. Because this is a manual process, however, inexperienced operators may often set the front and rear doors in the wrong position (e.g. too far open or too closed). When the doors are too closed, the material in the drum chamber may be subject to unnecessarily excessive mixing, which may affect the gradation of the mixture. Moreover, the unnecessary mixing may lead to excessive fuel consumption and excessive wear and tear of the milling drum teeth, which in turn may make the process inefficient and increase operating and maintenance costs for the reclaimer. Furthermore, when the doors are not sufficiently open, excess material may accumulate in the drum chamber and the relatively smaller gap between the door and the ground may restrict the amount of material exiting the drum chamber. The doors may also dig into the ground surface causing excessive drag on the machine, resulting in wheel slip and a slow down in a forward movement of the reclaimer, increasing the amount of time required for a particular mixing operation. In contrast, when the doors are too far open, the material in the chamber may be mixed insufficiently, producing relatively larger particle sizes and an uneven distribution of particle sizes in the material exiting the drum chamber. This in turn may result in a poor quality of the reconstituted material deposited by the reclaimer.

The reclaimer of the present disclosure solves one or more of the problems set forth above and/or other problems of the prior art.

SUMMARY

In one aspect, the present disclosure is directed to a reclaimer. The reclaimer may include a frame and a plurality of wheels connected to the frame. The reclaimer may also include a drum chamber connected to the frame. The drum chamber may extend along a width of the frame. The reclaimer may include a movable door attached to the drum chamber and extending along the width of the frame. The reclaimer may also include a milling drum positioned within the drum chamber and configured to engage with a ground surface. The reclaimer may include an engine configured to rotate the milling drum and propel the wheels such that material exits the drum chamber from under the movable door. Additionally, the reclaimer may include a controller. The controller may be configured to determine a position of the movable door based on at least one of a machine characteristic and a predetermined gradation for the material exiting from the drum chamber. The controller may also be configured to selectively adjust an actuator associated with the movable door based on the determined position.

In another aspect, the present disclosure is direct to a method of operating a reclaimer having a frame supported by a plurality of wheels connected to the frame by a plurality of legs, a milling drum attached to the frame, and a drum chamber surrounding the milling drum. The method may include adjusting a height of the milling drum relative to the frame. The method may also include rotating the milling drum to cut a ground surface. Further, the method may include mixing material cut by the milling drum in the drum chamber. The method may include propelling the wheels in a milling direction and allowing the material to exit the drum chamber from under a movable door of the drum chamber. The method may also include determining, using a controller, a position of the movable door based on at least one of a machine characteristic and a predetermined gradation for the material exiting from the drum chamber. Further, the method may include selectively adjusting an actuator associated with the movable door based on the determined position.

In yet another aspect, the present disclosure is directed to a reclaimer. The reclaimer may include a frame. The reclaimer may include a left front wheel connected to a front end of the frame and a right front wheel connected to the front end and spaced apart from the left front wheel. Further, the reclaimer may include a left rear wheel connected to a rear end of the frame and a right rear wheel connected to the rear end and spaced apart from the left rear wheel. The reclaimer may include a left arm pivotably connected to the frame and extending from the frame. The reclaimer may also include a right arm pivotably connected to the frame and extending from the frame. The reclaimer may include a cross tube connecting the left arm and the right arm, and at least one actuator connecting the frame and the cross tube. The reclaimer may also include a milling drum rotatably connected to free ends of the left and right arms. Further, the reclaimer may include a drum chamber configured to enclose the milling drum, the drum chamber extending along a width of the frame. The reclaimer may include a movable rear door attached to the drum chamber and extending along the width of the frame. The reclaimer may also include a movable front door attached to the drum chamber and extending along the width of the frame. The reclaimer may include an engine configured to rotate the milling drum and propel the wheels such that material exits the drum chamber from under the rear door. In addition, the reclaimer may include a controller. The controller may be configured to determine a position of at least one of the rear door and the front door based on at least one of a machine characteristic and a predetermined gradation for the material exiting from the drum chamber. The controller may also be configured to selectively adjust an actuator associated with at least one of the rear door and the front door based on the determined position.

DETAILED DESCRIPTION

Figure 1:
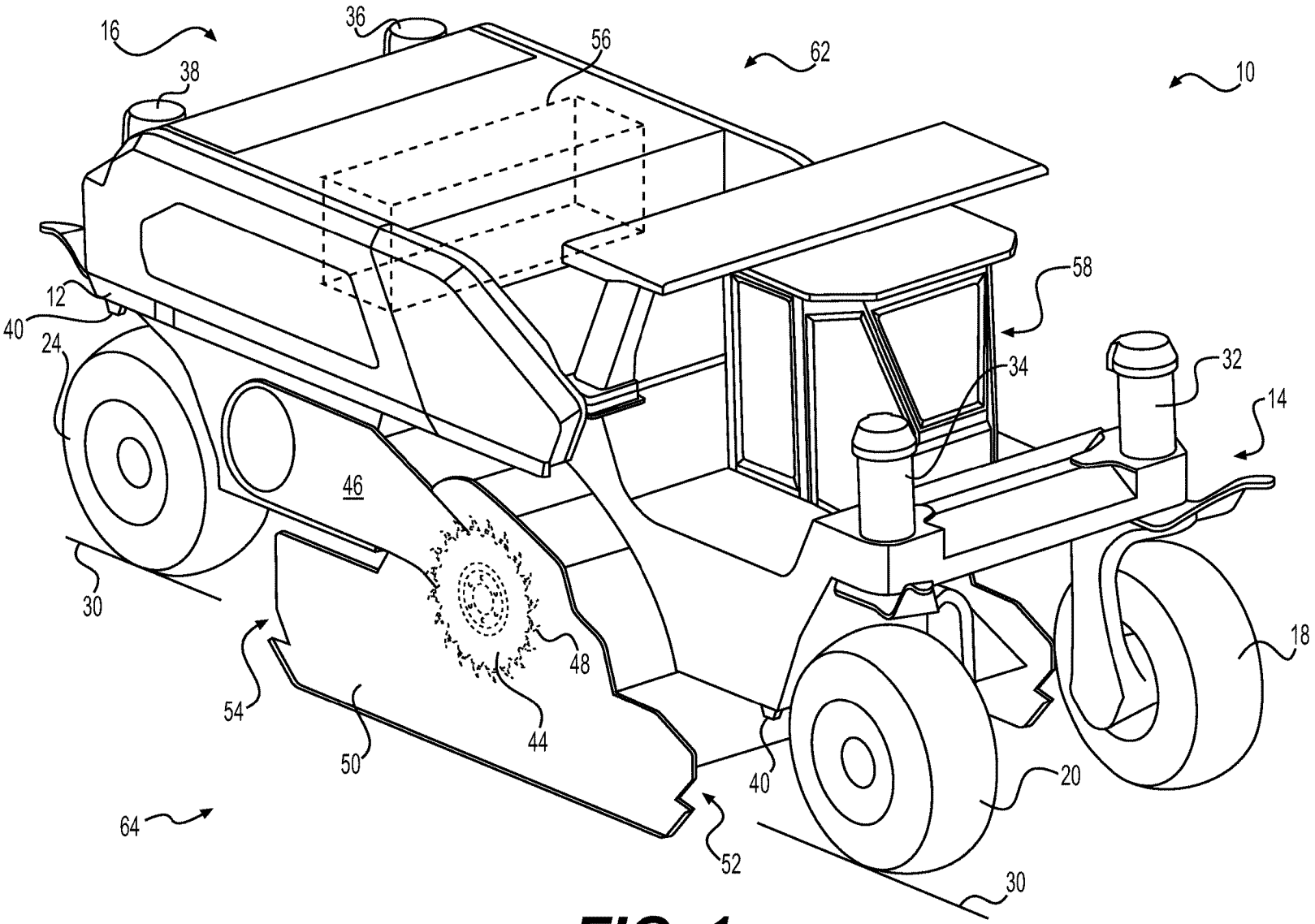
FIG. 1 is an illustration of an exemplary reclaimer.

FIG. 1 illustrates an exemplary machine 10. In one exemplary embodiment as illustrated in FIG. 1, machine 10 may be a reclaimer, which may also be called rotary mixer, soil stabilizer, reclaiming machine, road reclaimer, etc. Reclaimer 10 may include frame 12, which may extend from first end 14 to second end 16 disposed opposite first end 14. In some exemplary embodiments, first end 14 may be a front end and second end 16 may be a rear end of frame 12. Frame 12 may have any shape (e.g. rectangular, triangular, square, etc.)

Frame 12 may be supported on one or more propulsion devices 18, 20, 22 (not visible in FIG. 1), 24. Propulsion devices 18, 20, 22, 24 may be equipped with electric or hydraulic motors which may impart motion to propulsion devices 18, 20, 22, 24 to help propel reclaimer 10 in a forward or rearward direction. In one exemplary embodiment as illustrated in FIG. 1, propulsion devices 18, 20, 22, 24 may take the form of wheels. It is contemplated, however, that propulsion devices 18, 20, 22, 24 of reclaimer 10 may take the form of tracks, which may include, for example, sprocket wheels, idler wheels, and/or one or more rollers that may support a continuous track. In the present disclosure, the terms wheel and track will be used interchangeably and will include the other of the two terms.

Wheels 18, 20 may be located adjacent first end 14 of frame 12 and may be spaced apart from wheels 22, 24, respectively, in a length direction of frame 12. Wheels 22, 24 may be located adjacent second end 16 of frame 12. Wheel 18 may be spaced apart from wheel 20 along a width direction of frame 12. Likewise, wheel 22 may be spaced apart from wheel 24 along a width direction of frame 12. In one exemplary embodiment as illustrated in FIG. 1, wheel 18 may be a left front wheel, wheel 20 may be a right front wheel, wheel 22 may be a left rear wheel, and wheel 24 may be a right rear wheel. Some or all of propulsion devices 18, 20, 22, 24 may also be steerable, allowing machine 10 to be turned towards the right or left during a forward or rearward motion on ground surface 30. Although reclaimer 10 in FIG. 1 has been illustrated as including four wheels 18, 20, 22, 24, it is contemplated that in some exemplary embodiments, reclaimer 10 may have only one rear wheel 22 or 24, which may be located generally centered along a width of frame 12.

Frame 12 may be connected to wheels 18, 20, 22, 24 by one or more legs 32, 34, 36, 38. For example, as illustrated in FIG. 1, frame 12 may be connected to left front wheel 18 via leg 32 and to right front wheel 20 via leg 34. Likewise, frame 12 may be connected to left rear wheel 22 via leg 36 and to right rear wheel 24 via leg 38. One or more of legs 32, 34, 36, 38 may be height adjustable such that a height of frame 12 relative to one or more of wheels 18, 20, 22, 24 may be increased or decreased by adjusting a length of one or more of legs 32, 34, 36, 38, respectively. For example, legs 32, 34, 36, 38 may be equipped with leg actuators (not shown), which when extended or retracted may adjust the lengths of legs 32, 34, 36, 38. Leg actuators may be disposed outside or within legs 32, 34, 36, 38. These leg actuators may include, for example, single-acting or double-acting hydraulic or pneumatic piston-cylinder type actuators.

It will be understood that adjusting a height of frame 12 relative to one or more of wheels 18, 20, 22, 24 would also adjust a height of frame 12 relative to ground surface 30 on which wheels 18, 20, 22, 24 may be supported. Reclaimer 10 may be equipped with one or more height sensors 40. For example, as illustrated in FIG. 1, height sensors 40 may be positioned on frame 12 adjacent front end 14 and/or adjacent rear end 16. Although FIG. 1 illustrates height sensors 40 only on right side 64 of reclaimer 10, it is contemplated that height sensors 40 may also be positioned on frame 12 on left side 62. Reclaimer 10 may include any number of height sensors 40, which may be positioned anywhere on frame 12.

Figure 2:
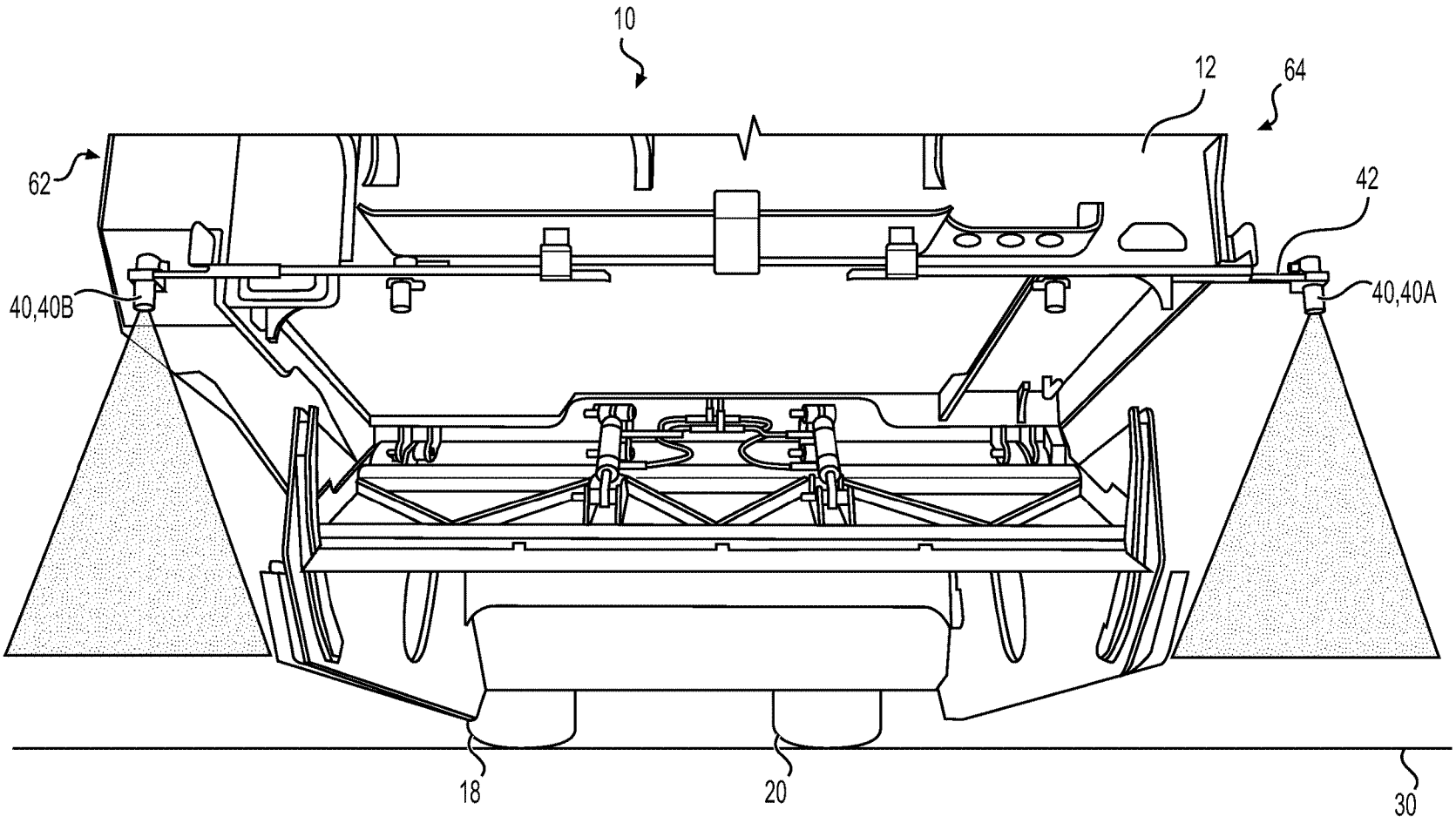
FIG. 2 is a partial view illustration of a rear elevation of the exemplary reclaimer of FIG. 1.

FIG. 2 illustrates a partial elevation view of reclaimer 10 as viewed from rear end 16. As illustrated in FIG. 2, reclaimer 10 may include one or more extenders 42 that may be attached to frame 12. Extenders 42 may include, for example, telescoping or stationary, structural beams extending up to or beyond a width of frame 12. One or more height sensors may be attached to extender 42. As illustrated in FIG. 2, height sensor 40A may be disposed on right side 64 of reclaimer 10 in an outboard position. That is, extender 42 may extend outward beyond a width of frame 12 to position height sensor 40A outside of a footprint of frame 12. As also illustrated in FIG. 2, height sensor 40B may be disposed on left side 62 of reclaimer 10 in an inboard position. That is, extender 42 may not extend beyond a width of frame 12 and may position height sensor 40A within a footprint of frame 12. It is contemplated that each of height sensors 40A, 40B may be positioned at an inboard or outboard position. Although FIG. 2 illustrates an extender 42 attached to frame 12 adjacent rear end 16, it is contemplated that extenders 42 may additionally or alternatively be attached to frame 12 adjacent front end 16 or at any other location between front end 14 and rear end 16 of frame 12.

Height sensor 40 may be configured to determine a height of frame 12 relative to ground surface 30. In one exemplary embodiment, height sensor may be an ultrasonic sensor configured to determine the height based on reflected ultrasonic sound waves. It is contemplated, however, that other types of height sensors 40 may be used on reclaimer 10. For example, height sensor 40 may include one or more laser sensors, one or more single-beam LIDAR sensors, multi-beam LIDAR sensors, multi-layer LIDAR sensors, RADAR sensors, inertial sensors, etc. It is contemplated that reclaimer 10 may include a same type of sensor (e.g. LIDAR, RADAR, ultrasonic, laser, etc.) or may include sensors of different types at different locations on frame 12. In some exemplary embodiments, height sensor 40 may be capable of detecting the height of frame 12 relative to ground surface 30 based on a reflection of electromagnetic radiation from ground surface 30. For example, height sensor 40 may include a transmitter configured to transmit electromagnetic radiation toward ground surface 30 and a receiver configured to receive the reflected electromagnetic radiation from ground surface 30. The electromagnetic radiation may include, for example, visible light, infrared light, ultraviolet light, laser light, radio waves or microwaves. In other exemplary embodiments, height sensor 40 may include one or more imaging devices. For example, height sensor 40 may include one or more mono or stereo cameras configured to obtain 2D or 3D images of ground surface 30 and/or one or more propulsion devices 18, 20, 22, 24. Such a height sensor 40 may also include a processor configured to execute one or more image processing algorithms (e.g. photogrammetry, segmentation, edge detection, projection, convolution, extrapolation) to determine a height of frame 12 relative to ground surface 30. It is also contemplated that in some exemplary embodiments, height sensor 40 may be a contact type sensor having a sensor element touch ground surface 30 and/or a stringline disposed at a predetermined height above ground surface 30. Movement of the sensor element may be used to determine changes in a height of frame 12 relative to ground surface 30. It is further contemplated that in some exemplary embodiments, height sensor 40 may include a Global Positioning System (GPS) sensor configured to determine a height of frame 12 relative to ground surface 30 based on signals communicated between height sensor 40 and one or more GPS satellites. It is also contemplated that in some exemplary embodiments, one or more of the leg actuators associated with legs 32, 34, 36, 38 may include one or more position sensing devices configured to determine an amount of extension of the leg actuators. The one or more position sensing devices may be similar to position sensing devices discussed with respect to actuator 108 below. In these exemplary embodiments, a controller of reclaimer 10 may be configured to determine a height of frame 12 relative to ground surface 30, using signals received from the one or more position sensing devices associated with the leg actuators of one or more of legs 32, 34, 36, 38.

Returning to FIG. 1, milling drum 44 of reclaimer 10 may be located between first end 14 and second end 16. It is to be understood that the term milling drum includes terms such as drum, cutting drum, working drum, mixing drum, etc. In one exemplary embodiment as illustrated in FIG. 1, milling drum 44 of reclaimer 10 may not be directly attached to frame 12. Instead, as illustrated in FIG. 1 milling drum 44 of reclaimer 10 may be connected to frame 12 via arms 46. Arms 46 may include a pair of arms (only one of which is visible in FIG. 1) disposed on either side of reclaimer 10 along a width direction of frame 12. As also illustrated in FIG. 1, arms 46 may extend from frame 12 towards front end 14 of frame 12. It is contemplated, however, that in other exemplary embodiments of reclaimer 10, arms 46 may extend from frame 12 towards rear end 16 of frame 12. Milling drum 44 may be attached to free ends of arms 46. Milling drum 44 of reclaimer 10 may include cutting tools 48 (or teeth 48).

A height of milling drum 44 above the ground surface may be adjusted by rotating arms 46 relative to frame 12 and/or by adjusting a height of one or more of legs 32, 34, 36, 38. As milling drum 44 rotates, teeth 48 may come into contact with and tear or cut the ground surface 30 or roadway surface. Milling drum 44 may be enclosed within drum chamber 50 which may help contain the material removed by teeth 48 from the ground or roadway surface. Milling drum 44 may be movable within drum chamber 50 such that a height between an upper surface of milling drum 44 and an inner surface of drum chamber 50 may be variable. In some exemplary embodiments, drum chamber 50 may be fixedly attached to frame 12. It is contemplated, however, that in other exemplary embodiments, drum chamber 50 may be movable relative to frame 12. It is also contemplated that in some exemplary embodiments, one or more height sensors 40 may additionally or alternatively be positioned anywhere on drum chamber 50 and may be configured to determine a height of drum chamber 50 relative to ground surface 30.

Rotation of milling drum 44 may cause the material removed from ground surface 30 to be transferred from adjacent front end 52 of drum chamber 50 towards rear end 54 of drum chamber 50. It is also contemplated that in some exemplary embodiments, rotation of milling drum 44 may cause the removed material to instead be transferred from adjacent rear end 54 of drum chamber 50 towards front end 52 of drum chamber 50. Stabilizing components such as ash, lime, cement, water, etc. may be mixed with the removed material and the reconstituted mixture of the milled material and the stabilizing components may be deposited on ground surface 30. Milling drum 44 may help mix the removed material with the stabilizing components. Material may exit drum chamber 50 adjacent rear end 54 from under a movable rear door (not shown) as reclaimer 10 is propelled, for example, in a forward direction (from rear end 16 towards front end 14), which may be the milling direction. It is contemplated that in some exemplary embodiments, material may instead exit drum chamber 50 adjacent front end 52 from under a movable front door (not shown) as reclaimer 10 is propelled, for example, in a rearward direction (from front end 14 towards rear end 16). Material exiting drum chamber 50 may include material removed by milling drum 44 from ground surface 30. It is also contemplated that material exiting drum chamber 50 may include the reconstituted mixture of the material removed by milling drum 44 from ground surface 30 and the stabilizing components.

Reclaimer 10 may also include engine 56 and operator platform 58. Engine 56 may be any suitable type of internal combustion engine, such as a gasoline, diesel, natural gas, or hybrid-powers engine. It is contemplated, however, that in some exemplary embodiments, engine 56 may be driven by electrical power. Engine 56 may be configured to deliver rotational power output to one or more hydraulic motors associated with propulsion devices 18, 20, 22, 24, and to milling drum 44. Engine 56 may also be configured to deliver power to operate one or more other components or accessory devices (e.g. pumps, fans, motors, generators, belt drives, transmission devices, etc.) associated with reclaimer 10. Further, engine 56 may be configured to deliver power to one or more actuators, for example, actuators responsible for moving arms 46 and/or the movable front and rear doors of drum chamber 50.

Operator platform 58 may be attached to frame 12. In some exemplary embodiments, operator platform 58 may be in the form of an open-air platform that may or may not include a canopy. In other exemplary embodiments, operator platform 58 may be in the form of a partially or fully enclosed cabin. Operator platform 58 may include one or more control or input devices (e.g. joysticks, levers, buttons, dials, switches, pedals, touch screens, etc.) that may be used by an operator of reclaimer 10 to control operations of reclaimer 10. Although operator platform 58 is illustrated in FIG. 1 as positioned generally midway about a width of reclaimer 10, operator platform 58 may be configured to be positioned at different positions along the width of frame 12. Thus, for example, operator platform 58 may be configured to be movable from adjacent left side 62 of frame 12 to adjacent right side 64 of frame 12.

It will be understood that as used in this disclosure the terms front and rear are relative terms, which may be determined based on a direction of travel of reclaimer 10 or 80. Likewise, it will be understood that as used in this disclosure, the terms left and right are relative terms, which may be determined based on facing the direction of travel of reclaimer 10 or 80.

Figure 3:
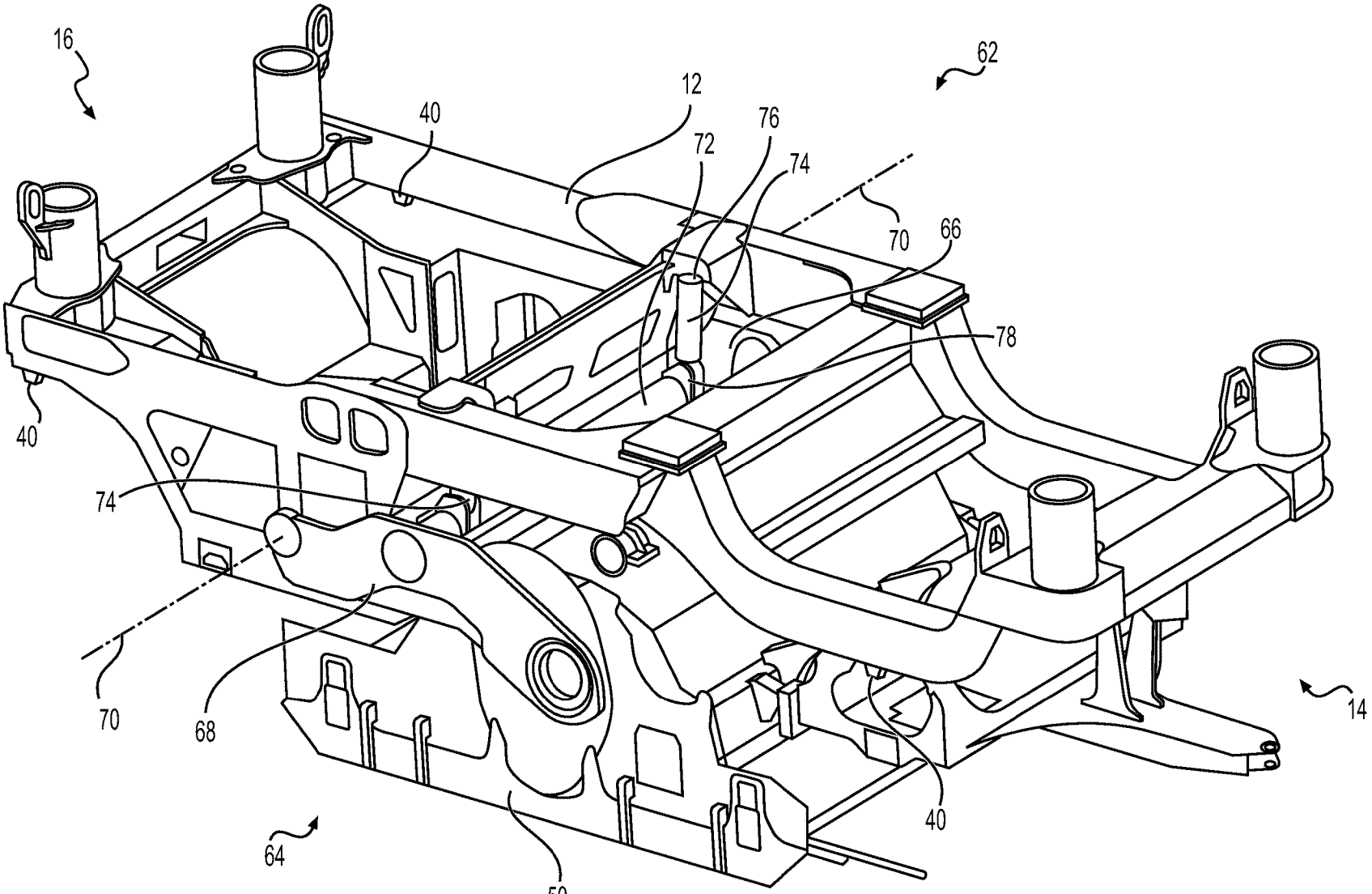
FIG. 3 is a another partial view illustration of the exemplary reclaimer of FIG. 1.

FIG. 3 illustrates a partial view of exemplary reclaimer 10. As illustrated in FIG. 3, arms 46 may include left arm 66 and right arm 68. Left arm 66 may be disposed on left side 62 of frame 12, and right arm 68 may be disposed on right side 64 of frame 12. Left and right arms 66, 68 may be pivotably attached to frame 12 and may be configured to be rotatable relative to frame 12. Left arm 66 and right arm 68 may have a common pivot axis 70 disposed transverse to frame 12 and generally parallel to a width direction of frame 12. Cross tube 72 may be fixedly connected at one end to left arm 66 and at an opposite end to right arm 68. One or more arm actuators 74 may be connected between frame 12 and cross tube 72. For example, one end 76 of arm actuator 74 may be connected to frame 12 and an opposite end 78 of arm actuator 74 may be connected to cross tube 72. In one exemplary embodiment, arm actuators 74 may be single-acting or double-acting hydraulic actuators. It is contemplated, however, that arm actuators 74 may be single-acting or double-acting pneumatic actuators or may include a rack and pinion arrangement, a belt and pulley arrangement, etc.

Figure 4:
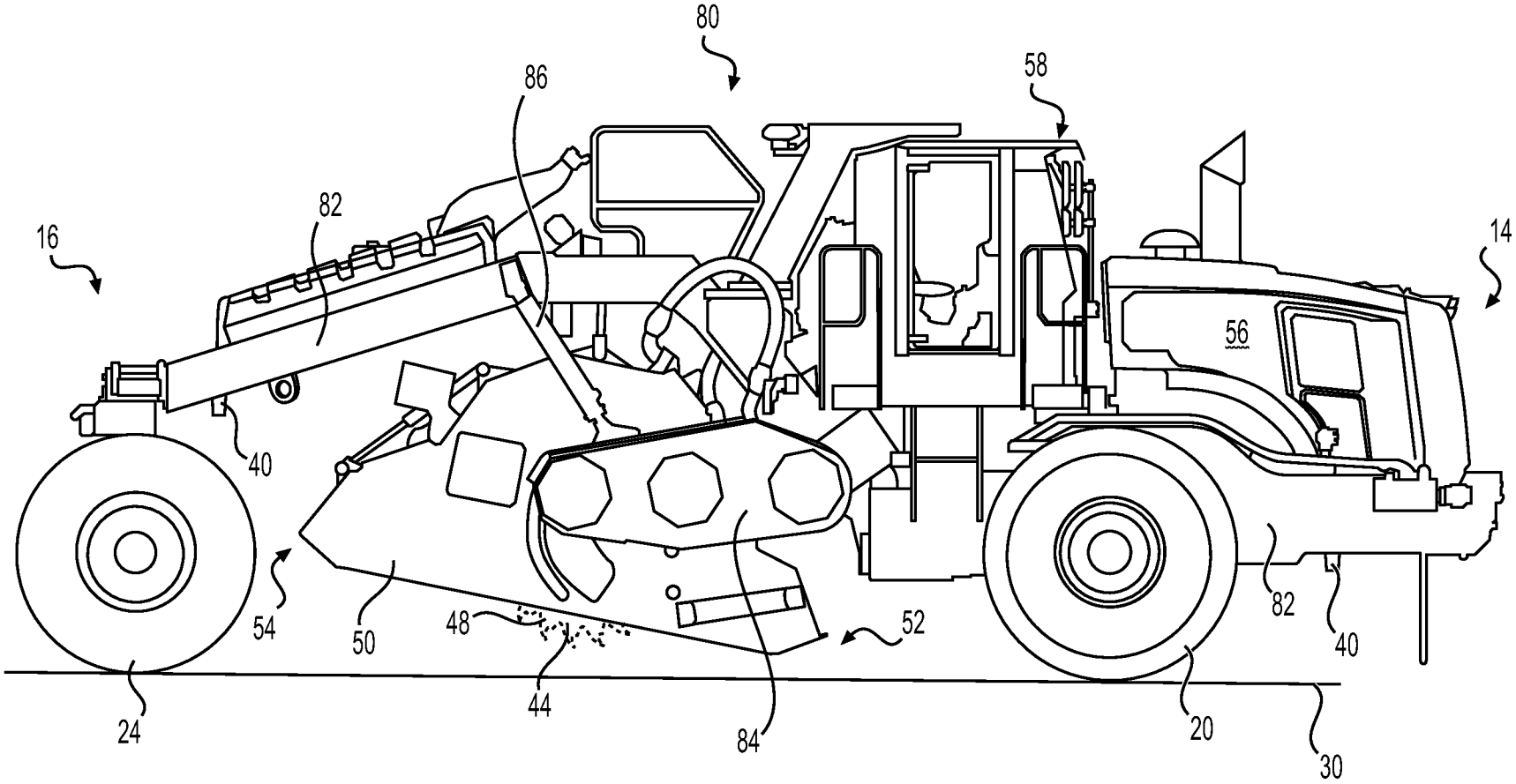
FIG. 4 is an illustration of another exemplary reclaimer.

FIG. 4 illustrates another exemplary machine 80. In one exemplary embodiment as illustrated in FIG. 4, machine 80 may be a reclaimer, rotary mixer, soil stabilizer, reclaiming machine, road reclaimer, etc. Like reclaimer 10, reclaimer 80 may include frame 82 and propulsion devices in the form of wheels 18 (not visible in FIG. 4), 20, 22 (not visible in FIG. 4), 24. Frame 82 of reclaimer 80 may extend from adjacent first end 14 to adjacent second end 16. In some exemplary embodiments, first end 14 may be a front end and second end 16 may be a rear end of frame 12. Frame 12 may have any shape (e.g. rectangular, triangular, square, etc.)

Propulsion devices 18, 20, 22, 24 may be connected to frame 82. Unlike reclaimer 10, however, frame 82 of reclaimer 80 may not be configured to be raised or lowered relative to propulsion devices 18, 20, 22, 24 and/or ground surface 30. Propulsion devices 18, 20 may be separated from each other along a width direction of reclaimer 80 and may be positioned adjacent first end 14. Similarly, propulsion devices 22, 24 may be separated from each other along a width direction of reclaimer 80 and may be positioned adjacent second end 16. Although propulsion devices 18, 20, 22, 24 have been illustrated as wheels in FIG. 3, it is contemplated that propulsion devices 18, 20, 22, 24 may instead include tracks. One or more of propulsion devices 18, 20, 22, 24 may be steerable, allowing reclaimer 10 to be turned towards the right or left during a forward or rearward motion on ground surface 30.

Reclaimer 80 may include milling drum 44 located between first end 14 and second end 16. In one exemplary embodiment as illustrated in FIG. 3, milling drum 44 of reclaimer 10 may not be directly attached to frame 82. Instead, as illustrated in FIG. 4 milling drum 44 of reclaimer 80 may be attached to frame 82 via arms 84. Arms 84 may include a pair of arms (only one of which is visible in FIG. 4) disposed on either side of reclaimer 80. Arms 84 may be pivotably attached to frame 82 and may be configured to be rotatable relative to frame 82. One or more actuators 86 may be connected between frame 82 and arms 84 and may be configured to move arms 84 relative to frame 82.

Milling drum 44 of reclaimer 80 may include cutting tools 48 (or teeth 48). A height of milling drum 44 above the ground surface may be adjusted by rotating arms 84 relative to frame 82. As milling drum 44 rotates, teeth 48 may come into contact with and tear or cut the ground or roadway surface. Milling drum 44 may be enclosed within drum chamber 50 which may help contain the material removed by teeth 48 from ground surface 30. Drum chamber 50 may be connected to frame 82 and may be movable relative to frame 12. Further, milling drum 44 may be movable within drum chamber 50 such that a height between an upper surface of milling drum 44 and an inner surface of drum chamber 50 may be variable.

Rotation of milling drum 44 may cause the removed material to be transferred from adjacent front end 52 of drum chamber 50 towards rear end 54 of drum chamber 50. It is contemplated, however, that in some exemplary embodiments, rotation of milling drum 44 may cause the removed material to be transferred from adjacent rear end 54 of drum chamber 50 towards front end 52 of drum chamber 50. Stabilizing components such as ash, lime, cement, water, etc. may be mixed with the removed material and the reconstituted mixture of the milled material and the stabilizing components may be deposited on ground surface 30. Milling drum 44 may help mix the removed material with the stabilizing components. Material may exit drum chamber 50 adjacent rear end 54 from under a movable rear door (not shown) as reclaimer 80 is propelled, for example, in a forward direction (from second end 16 towards first end 14), which may be the milling direction. It is contemplated that in some exemplary embodiments, material may instead exit drum chamber 50 adjacent front end 52 from under a movable front door (not shown) as reclaimer 80 is propelled, for example, in a rearward direction (from first end 14 towards second end 16). Material exiting drum chamber 50 may include material removed by milling drum 44 from ground surface 30. It is also contemplated that material exiting drum chamber 50 may include the reconstituted mixture of the material removed by milling drum 44 from ground surface 30 and the stabilizing components.

Like reclaimer 10, reclaimer 80 may also include engine 56, operator platform 58, and one or more height sensors 40, all of which may have structural and functional characteristics similar to those discussed above with respect to reclaimer 10. Like height sensors 40 on reclaimer 10, reclaimer 80 may also include any number of height sensors 40 attached to any portion of frame 82 and/or to any portion of drum chamber 50.

Figure 5A:
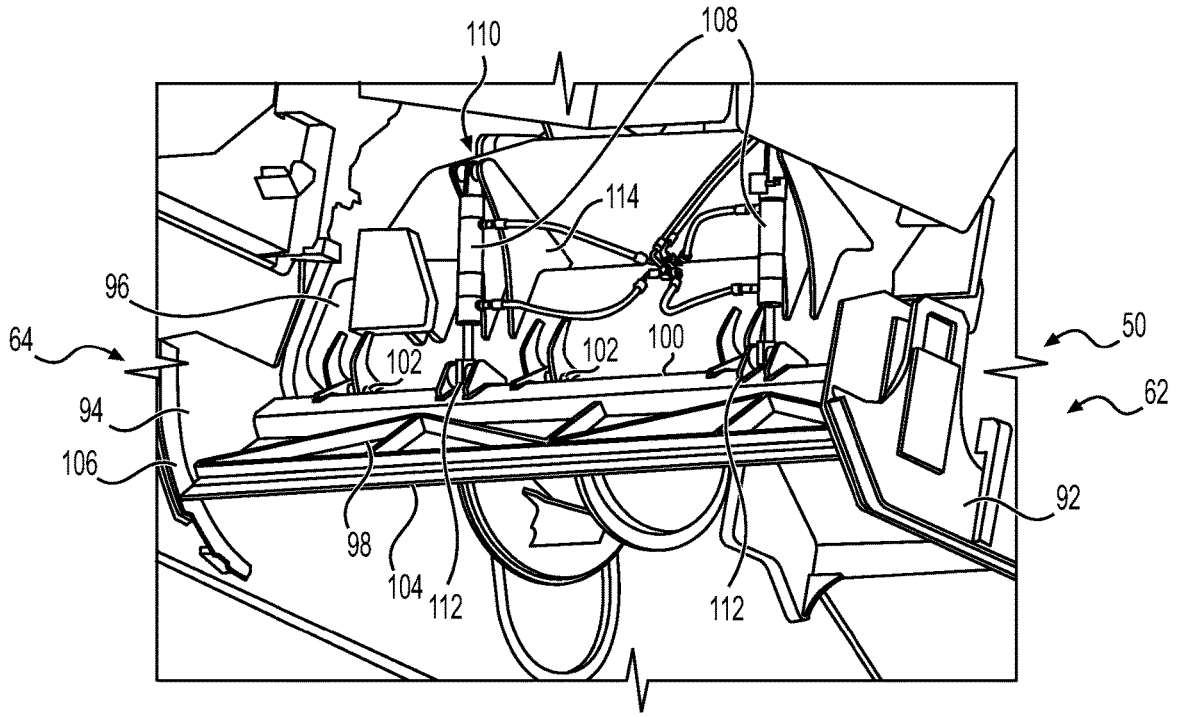
FIG. 5A is a partial front view illustration of an exemplary drum chamber of the reclaimers of FIGS. 1 and 4.

FIG. 5A illustrates a partial front view of an exemplary drum chamber 50 of reclaimer 10 or 80. As illustrated in FIG. 5A, drum chamber 50 may include side plates 92, 94, cover 96, and front door 98. For example, side plate 92 may be disposed on left side 62 of reclaimer 10, 80, whereas side plate 94 may be disposed on right side 64 of reclaimer 10, 80. Side plate 92 may also be spaced apart from and positioned opposite side plate 94. Drum chamber 50 may include cover 96. Side plates 92, 94 may be connected to opposite ends of cover 96. Front door 98 may extend across a width of drum chamber 50 from adjacent side plate 92 to adjacent side plate 94. Front door 98 may be pivotably connected to cover 96 and may be slidably movable relative to side plates 92, 94. In one exemplary embodiment as illustrated in FIG. 5A, upper edge 100 of front door 98 may be pivotably connected to cover 96 at hinged connections 102. Lower edge 104 of front door 98 may be configured to touch ground surface 30 or be positioned spaced apart from ground surface 30 during operations of reclaimer 10, 80. One or both side plates 92, 94 may be equipped with one or more guide plates 106 configured to guide a movement of front door 98 as it pivots from a fully-open position to a fully-closed position and vice-versa.

Drum chamber may also include one or more actuators 108. One end 110 of actuator 108 may be connected to cover 96, for example, via bracket 114. An opposite end 112 of actuator 108 may be connected to front door 98. Extraction or retraction of actuator 108 may cause front door 98 to pivot about hinged connections 102. Thus, for example, when actuator 108 is in its fully retracted position, front door 98 may be in its fully-open position in which lower edge 104 may be positioned at its maximum distance from ground surface 30. In contrast, when actuator 108 is in its fully extended position, front door 98 may be in its fully-closed position in which lower edge 104 may be in contact with ground surface 30 or positioned at a minimum distance from ground surface 30. Actuators 108 may be single-acting or double-acting hydraulic or pneumatic piston cylinder units. It is contemplated, however, that reclaimer 10, 80 may employ other types of actuators 108. For example, in one exemplary embodiment, actuator 108 may be a rotary actuator that may employ gear drives or other rotary mechanisms to pivot front door 98 about hinged connections 102.

Drum chamber 50 may include one or more position sensors 120 (see FIG. 6) configured to determine a position of front door 98. In one exemplary embodiment, position sensor 120 may be an inductive, resistive, or capacitive sensor disposed within actuator 108. For example, position sensor 120 may include sensing elements attached to a piston and a housing of actuator 108 and position sensor 120 may be configured to generate a signal representative of an amount of extension (e.g. increase in length) or retraction (e.g. decrease in length) of actuator 108 based on the inductance, resistance, or capacitance between the sensing elements. In another exemplary embodiment, position sensor 120 may be a wire rope sensor disposed outside or within actuator 108. The amount of extension of retraction of the wire rope may be used to determine an amount of extension or retraction of actuator 108. In yet another exemplary embodiment, actuator 108 may be equipped with limit switches or proximity sensors that may be triggered when a component (e.g. piston) of actuator 108 is positioned adjacent to a limit switch of proximity sensor.

It is also contemplated that position sensor 120 may include non-contact lidar, radar, laser, or other types of sensors configured to generate signals representing an amount of extension or retraction of actuator 108. In some exemplary embodiments, position sensor 120 may include a rotary encoder or other type of rotational sensor configured to determine an angle of rotation of front door 98 relative to cover 96. In yet other exemplary embodiments, position sensor 120 may be a contact or non-contact sensor, similar to height sensor 40, attached to frame 12, 82 of reclaimer 10, 80, respectively, and may be configured to generate a signal indicative of a distance between frame 12, 82 and front door 98. In other exemplary embodiments, position sensor 120 may include one or more imaging devices configured to obtain an image of front door 98. The imaging devices may include one or more processors configured to execute one or more image processing algorithms (e.g. photogrammetry, segmentation, edge detection, projection, convolution, extrapolation) to generate a signal indicative of a position of front door 98 relative to a location of position sensor 120. As will be discussed below, a controller associated with reclaimer 10, 80 may be configured to determine a position of front door 98 based on the signals received from any of the above-described position sensors 120.

Figure 5B:
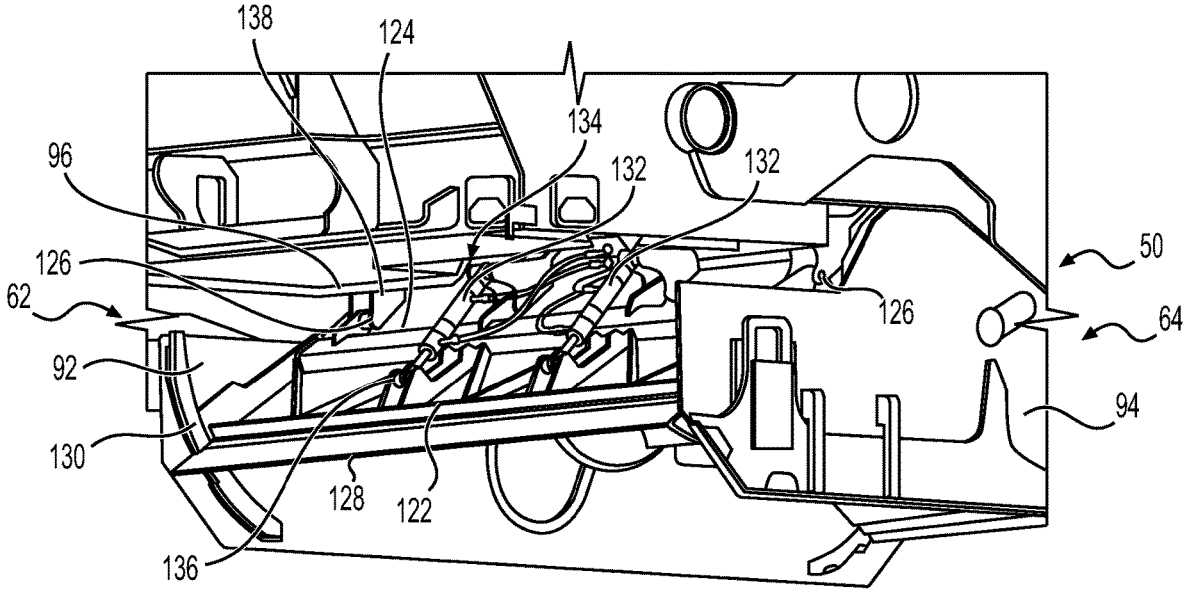
FIG. 5B is a partial rear view illustration of the exemplary drum chamber of the reclaimers of FIGS. 1 and 4.

FIG. 5B illustrates a partial rear view of an exemplary drum chamber 50 of reclaimer 10 or 80. As illustrated in FIG. 5B, drum chamber 50 may include rear door 122. Rear door 122 may extend across a width of drum chamber 50 from adjacent side plate 92 to adjacent side plate 94. Rear door 122 may be pivotably connected to cover 96 and may be slidably movable relative to side plates 92, 94. In one exemplary embodiment as illustrated in FIG. 5B, upper edge 124 of rear door 122 may be pivotably connected to cover 96 at hinged connections 126. Lower edge 128 of rear door 122 may be configured to touch ground surface 30 or be positioned spaced apart from ground surface 30 during operations of reclaimer 10, 80. One or both side plates 92, 94 may be equipped with one or more guide plates 130 configured to guide a movement of rear door 122 as it pivots from a fully-open position to a fully-closed position and vice-versa.

Drum chamber 50 may also include one or more actuators 132. One end 134 of actuator 132 may be connected to cover 96, for example, via bracket 138. An opposite end 136 of actuator 132 may be connected to rear door 122. Extraction or retraction of actuator 132 may cause rear door 122 to pivot about hinged connections 126. Thus, for example, when actuator 132 is in its fully retracted position, rear door 122 may be in its fully-open position in which lower edge 128 may be positioned at its maximum distance from ground surface 30. In contrast, when actuator 132 is in its fully extended position, rear door 122 may be in its fully-closed position in which lower edge 128 may be in contact with ground surface 30 or positioned at a minimum distance from ground surface 30. Actuators 132 may have similar structural and functional characteristics as actuators 108. For example, actuator 132 may include a single-acting or double-acting hydraulic or pneumatic piston cylinder unit. It is contemplated, however, that reclaimer 10, 80 may employ other types of actuators 132. For example, in one embodiment, actuator 132 may be a rotary actuator that may employ slew gear drives or other rotary mechanisms to pivot rear door 122 about hinged connections 126. Drum chamber 50 may include one or more position sensors 140 (see FIG. 6) configured to determine a position of rear door 122 between its fully-open and fully-closed positions. Position sensor 140 may have structural and functional characteristics similar to one or more types of position sensors 120 described above. As will be discussed below, a controller associated with reclaimer 10, 80 may be configured to determine a position of rear door 122 based on the signals received from any of the above-described position sensors 140.

Figure 6:
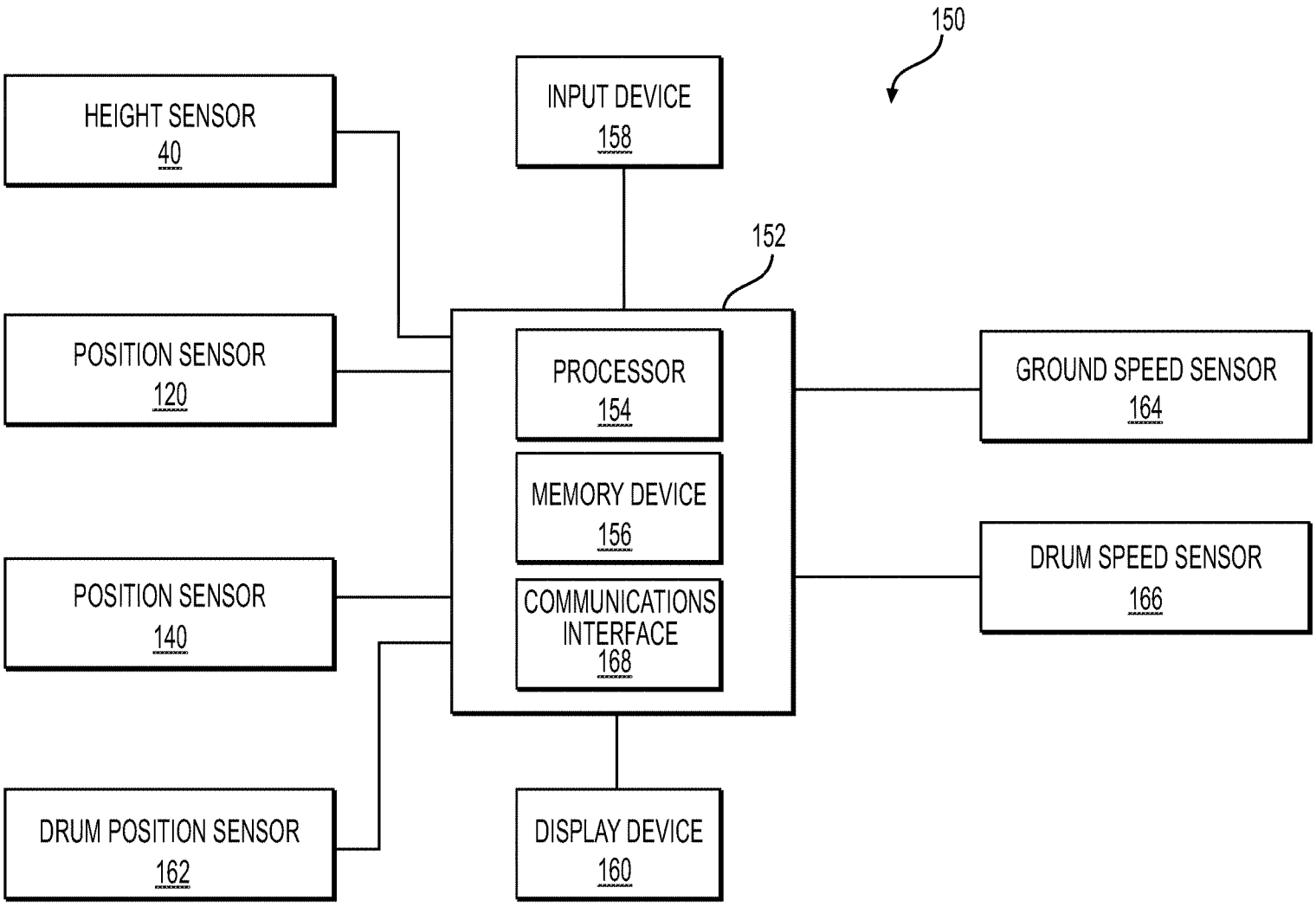
FIG. 6 is a schematic illustration of an exemplary disclosed drum chamber door control system for the reclaimers of FIGS. 1 and 4.

FIG. 6 shows an exemplary door control system 150 for controlling the positions of front door 98 and rear door 122 of drum chamber 50 during operations of reclaimer 10, 80. As described in greater detail below, door control system 150 may be configured to determine and/or maintain positions of front door 98 and/or rear door 122 relative to ground surface 30 based on a desired gradation for the material exiting drum chamber 50. As used in this disclosure gradation may refer to a particle size distribution in the material exiting drum chamber 50. For example, gradation may specify that x % by volume of the material should have particles of size A, y % by volume of the material should have particles of size B, etc. Gradation may also specify a maximum or minimum particle size that may be present in the material exiting drum chamber 50. Door control system 150 may determine and/or maintain the positions of front door 98 and/or rear door 122 of drum chamber 50 to obtain a desired gradation for the material exiting drum chamber 50. It is also contemplated that door control system 150 may determine the positions of front door 98 and/or rear door 122 of drum chamber 50 to ensure that reclaimer 10, 80 travels in the milling direction at a desired speed and/or while maintaining a predetermined fuel efficiency. In some exemplary embodiments, door control system 150 may be located onboard reclaimer 10, 80. In other exemplary embodiments, door control system 150 may be part of an overall machine autonomous control system, in which instructions from an off-board control system may be transmitted to reclaimer 10, 80, allowing reclaimer 10, 80 to perform operations based on predetermined requirements (e.g. predetermined gradation) and/or inputs received based on measurements from various sensors associated with reclaimer 10, 80.

Door control system 150 may include, for example, one or more controllers 152, input devices 158, display devices 160, height sensors 40, position sensors 120, 140, drum position sensors 162, ground speed sensors 164, drum speed sensors 166, and/or any other types of sensors that may measure one of more machine characteristics associated with reclaimers 10, 80. For example, door control system 150 may include torque sensors, power sensors, etc. to determine an amount of power being delivered by the engine during operations of reclaimers 10, 80. Additionally door control system 150 may include one or more of temperature sensors, pressure sensors, flow-rate sensors, etc.

Controller 152 may include one or more processors 154, memory devices 156, and/or communications interfaces 168. Controller 152 may be configured to control operations of one or more of input devices 158, display devices 160, actuators 86, 108, 132, and/or other components or operations of reclaimer 10, 80. Processor 154 may embody a single or multiple microprocessors, digital signal processors (DSPs), application-specific integrated circuit devices (ASICs), etc. Numerous commercially available microprocessors can be configured to perform the functions of processor 154. Various other known circuits may be associated with processor 154, including power supply circuitry, signal-conditioning circuitry, and communication circuitry.

The one or more memory devices 156 may store, for example, one or more control routines, instructions, and/or data for determining a position of front door 98 and/or rear door 122 and for controlling one or more other machine characteristics of reclaimers 10, 80. Memory device 156 may embody non-transitory computer-readable media, for example, Random Access Memory (RAM) devices, NOR or NAND flash memory devices, and Read Only Memory (ROM) devices, CD-ROMs, hard disks, floppy drives, optical media, solid state storage media, etc. Controller 152 may receive one or more input signals from the one or more input devices 158 and may execute the routines or instructions stored in the one or more memory devices 156 to generate and deliver one or more command signals to one or more of actuators 86, 108, 132, and/or other components of reclaimer 10, 80.

Communications interface 168 may allow software and/or data to be transferred between an off-board autonomous vehicle control system and controller 152. Examples of communications interface 168 may include a network interface (e.g., a wireless network card), a communications port, a PCMCIA slot and card, a cellular network card, a global positioning system (GPS) transceiver, etc. Communications interface 168 may transfer software and/or data in the form of signals, which may be electronic, electromagnetic, optical, or other signals capable of being transmitted and received by communications interface 168. Communications interface 168 may transmit or receive these signals using a radio frequency ("RF") link, Bluetooth link, satellite links, and/or other wireless communications channels. It is contemplated that in some exemplary embodiments, data or instructions may be received via communications interface 168 and may be stored in memory device 156. It is also contemplated that in some exemplary embodiments, one or more control signals for controlling the position of front door 98 and/or rear door 122 of drum chamber 50 may be received by controller 152 from an off-board controller via communications interface 168.

One or more input devices 158 may be located in operator platform 58. Input devices 158 may include one or more of joysticks, keyboards, knobs, levers, pedals, touch screens, or other input devices known in the art. An operator of reclaimer 10, 80 may use one or more input devices 158 to provide one or more inputs, which may be received by controller 152. For example, the one or more input device 158 may be configured to receive a predetermined gradation or a predetermined position of front door 98 and/or rear door 122 from the operator. Input devices 158 may also be used to operate reclaimer 10, 80 and may also be used to manually control actuators 86, 108, 132. Further, input devices 158 may be used to control a ground speed of reclaimer 10, 80 and/or to steer reclaimer 10, 80. The one or more input devices may also be used to control a speed of engine 56, a rotational speed of milling drum 44, and/or operations of other components of reclaimer 10, 80.

One or more display devices 160 may be associated with controller 152 and may be configured to display data or information in cooperation with processor 154. Display device 160 may be a cathode ray tube (CRT) monitor, a liquid crystal display (LCD), a light emitting diode (LED) display, a touchscreen display, or any other kind of display device known in the art.

Drum position sensor 162 may be associated with one or more of actuators 86. Drum position sensor 162 may be configured to generate a signal indicative of a position of milling drum 44 relative to frame 12 or 82. In one exemplary embodiment, drum position sensor 162 may be configured to generate a signal indicative of a height of a bottommost portion (e.g. tip of the lowest tooth 48) of milling drum 44 relative to frame 12 or 82. Drum position sensor 162 may include one or more types of position sensors similar to those discussed above for position sensor 120.

Ground speed sensor 164 may be associated with one or more of propulsion devices 18, 20, 22, and 24 and may be configured to measure a speed (e.g. feet per second, miles per hour, etc.) at which propulsion devices 18, 20, 22, and 24 or reclaimers 10, 80 may be propelled over ground surface 30. Ground speed sensor 164 may be configured to generate one or more signals indicative of a ground speed of one or more of 18, 20, 22, and 24, and may send the one or more signals to controller 152. It is contemplated, however, that controller 152 may additionally or alternatively determine a ground speed of reclaimer 10, 80 in other ways, for example, using GPS sensors, inertial sensors, flow rate or pressure of hydraulic fluid in hydraulic motors associated with propulsion devices 18, 20, 22, 24, etc.

Drum speed sensor 166 may be associated with milling drum 44 and may be configured to measure a rotational speed of milling drum 44 (e.g. rpm or revolutions per minute). Drum speed sensor 166 may be configured to generate and send one or more signals indicative of the rotational speed of milling drum 44 to controller 152. It is also contemplated that controller 152 may additionally or alternatively determine the rotational speed of the milling drum based on other parameters such as rotational speed of the engine, transmission or gear ratio, etc.

Controller 152 (or processor 154) may be configured to determine a position of one or both of front door 98 and/or rear door 122 based on input parameters specified by an operator of reclaimer 10, 80 and one or more machine characteristics associated with reclaimer 10, 80. For example, input parameters specified by an operator may include a predetermined position of front door 98, a predetermined position of rear door 122, a predetermined gradation, a predetermined ground speed, etc. Machine characteristics associated with reclaimer 10, 80 may include, for example, height of frame 12, 82 relative to ground surface 30, a position of milling drum 44 (e.g. height of milling drum 44 relative to frame 12, 82), height of drum chamber 50 relative to ground surface 30, ground speed of reclaimer 10, 80, rotational speed of milling drum 44, an engine characteristic of engine 56, etc. Engine characteristics of engine 56 may include, for example, engine speed, engine torque, rate of fuel consumption, amount of power generated by engine 56, fuel efficiency, etc. It is to be understood that the above-described list of machine and/or engine characteristics is not limiting and additional machine and/or engine characteristics may be employed.

It is also contemplated that in some exemplary embodiments, reclaimer 10, 80 may include a reader configured to read a key fob, card, etc. associated with an operator. Controller 152 may receive the information stored in the key fob, card, etc. and determine an identifier associated with the operator of the machine based on that information. In other exemplary embodiments, an operator may enter identifying information using the one or more input devices 158. Controller 152 may be configured to retrieve stored machine characteristics associated with the identifying information for the operator. Controller 152 may use the retrieved machine characteristics and/or thresholds to determine the positions of the front door 98 and/or rear door 122. The saved machine characteristics may help ensure that the machine may be quickly set up for a particular job or a type of operation. Controller 152 may also be configured to save machine characteristics and/or thresholds specified by an operator in memory device 156 and/or transmit the saved machine characteristics to an offboard control system via communications interface 168. Operations of controller 152 are described in further detail with respect to FIG. 7 below.

INDUSTRIAL APPLICABILITY

The drum chamber door control system of the present disclosure may be used to continuously adjust the position of front and/or rear doors of the drum chamber of a reclaimer as the reclaimer travels over a ground surface of a work site to perform operations. In particular, the drum chamber door control system of the present disclosure may determine the position of the front and/or rear doors of the drum chamber based on an input height of front door 98 and/or rear door 122 above the ground surface or a predetermined gradation provided by an operator and one or more machine characteristics to ensure that the material exiting the drum chamber has the predetermined gradation. By doing so, the drum chamber door control system of the present disclosure may eliminate the need for an operator to manually adjust the doors based solely on visual observations of the door positions and visual observations of the material being deposited on the ground surface. Moreover, the drum chamber door control system of the present disclosure may help reduce the likelihood of the front and/or rear doors of the drum chamber digging into the ground surface. This in turn may help reduce the likelihood of reduced ground speed of the reclaimer, excessive fuel consumption, excessive load on the engine, and/or inefficient reclaiming operations. The drum chamber control system of the present disclosure may also help reduce unnecessary or excessive mixing of material within the drum chamber before the material exits the drum chamber. An exemplary method of operation of drum chamber door control system 150 will be discussed below.

Figure 7:
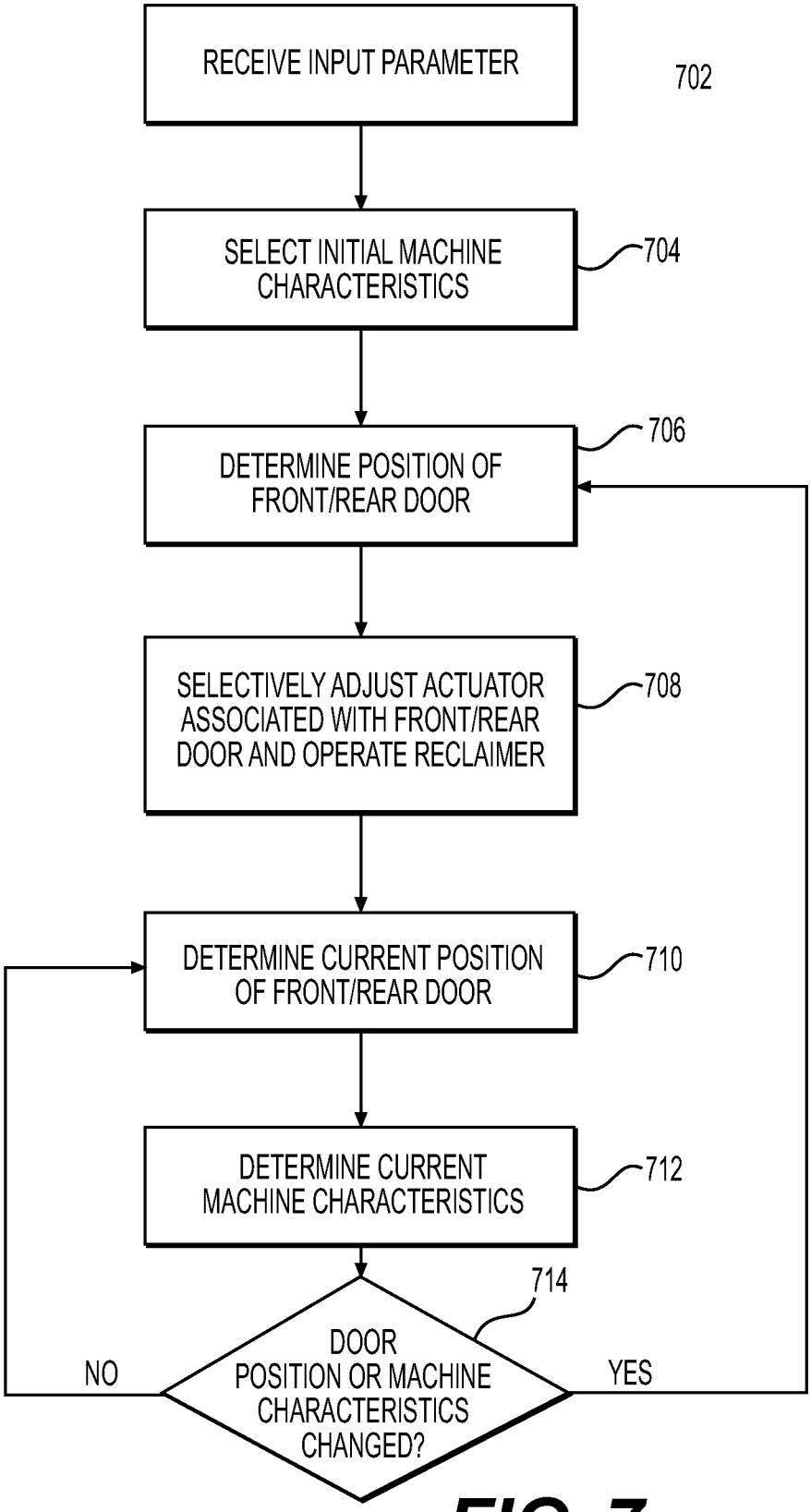
FIG. 7 is a flowchart illustrating an exemplary disclosed drum chamber door control method performed by the drum chamber door control system of FIG. 6

FIG. 7 illustrates an exemplary method 700 of operating a reclaimer 10 or 80 having the drum chamber door control system 150. The order and arrangement of steps of method 700 is provided for purposes of illustration. As will be appreciated from this disclosure, modifications may be made to method 700 by, for example, adding, combining, removing, and/or rearranging the steps of method 700. Method 700 may be executed by controller 152 by, for example, using processor 154 to execute one or more instructions stored in memory device 156.

Method 700 may include a step of receiving one or more input parameters (Step 702). The input parameters may include, for example, one or more of a predetermined height of front door 98 above ground surface 30, a predetermined height of rear door 122 above ground surface 30, or a predetermined gradation (e.g. desired or target gradation). The one or more input parameters may be received from an operator of reclaimer 10, 80, for example, via the one or more input devices 158 associated with reclaimer 10, 80.

Method 700 may include a step of selecting one or more initial machine characteristics (Step 704). For example, in step 704, an operator of reclaimer 10, 80 may select machine characteristics such as a height of frame 12 above ground surface, a depth of cut of milling drum 44, a desired ground speed of reclaimer 10, 80, a desired engine speed, a desired amount or rate of supply of stabilizing materials, etc. It will be understood that for reclaimer 80, instead of selecting a height of frame 82 above ground surface, an operator may select a height of drum chamber 50 relative to frame 82. The operator may used the one or more input devices 158 to adjust one or more actuators, or other components of reclaimer 10, 80 such that reclaimer 10, 80 has the selected machine characteristics.

Method 700 may include a step of determining a position of front door 98 and/or rear door 122 of drum chamber 50 (Step 706). When an operator provides a predetermined height of the front door 98 and/or rear door 122 above ground surface 30 in step 702, controller 152 may set the position of front door 98 and/or rear door 122 based on the operator specified predetermined height. For example, controller 152 of reclaimer 10 may receive signals from height sensors 40, indicating a current height of frame 12 above ground surface 30. Alternatively, for reclaimer 80, a height of frame 82 relative to ground surface 30 may be stored in memory device 156 and controller 152 may receive the height of frame 82 above ground surface 30 from memory device 156. Further, controller 152 may receive signals from one or more drum position sensors 162, indicating a current position of milling drum 44 relative to frame 12, 82. Additionally or alternatively, controller 152 may also receive signals from one or more height sensors 40 associated with drum chamber 50, indicating a current height of drum chamber 50 above ground surface 30. Controller 152 may determine a position of front door 98 and/or rear door 122 based on the predetermined height, the current height of frame 12, 82 above ground surface 30, a current height of drum chamber 50 above ground surface 30, and/or a depth of cut of milling drum 44 determined based on a current position of milling drum 44. Controller 152 may use one or more of look-up tables, correlations, geometric models, algorithms etc. to determine the position of front door 98 and/or rear door 122.

When, however, the operator provides a predetermined gradation as an input in step 702, controller 152 may determine the position of front door 98 and/or rear door 122 based on the predetermined gradation and one or more of the machine characteristics selected by the operator in, for example, step 704. By way of example, controller 152 may determine a depth of cut of milling drum 44 based on a height of frame 12 or 82 relative to ground surface 30, a height of drum chamber 50 relative to ground surface 30, and/or a height of milling drum 44 relative to frame 12 or 82. Controller 152 may also determine an amount of material that will be removed by milling drum 44 based on the depth of cut and a ground speed of reclaimer 10 or 80. Controller 152 may also determine an amount of mixture that may be generated in drum chamber 50 based on the amount of material removed by milling drum 44 and the amount (e.g. mass, volume, mass flow rate, volume flow rate, etc.) of stabilizing components provided. Controller 152 may then determine a position of front door 98 and/or rear door 122 that may be required to obtain the desired or predetermined gradation.

In one exemplary embodiment, controller 152 may determine the position of front door 98 and/or rear door 122 using one or more of look-up tables, flow charts, physical models, machine learning models, simulations, or other algorithms known in the art. For example, memory device 156 may store one or more look-up tables correlating gradation and front and/or rear door positions with one or more of frame height, milling drum position, ground speed, engine speed, engine torque, power delivered by the engine, fuel consumption, amount or rate of supply of stabilizing material etc. Controller 152 may employ one or more of these look-up tables stored in memory device 156 to determine the position of front door 98 and/or rear door 122 for a predetermined gradation based on the machine characteristics selected by the operator in, for example, step 704. In other exemplary embodiments, memory device 156 may store one or more mathematical or numerical correlations, or algorithms that may correlate gradation and front and/or rear door positions with one or more of frame height, milling drum position, ground speed, engine speed, engine torque, power delivered by the engine, fuel consumption, amount or rate of supply of stabilizing material etc. Controller 152 may employ the one or more mathematical or numerical correlations or algorithms to determine the position of front door 98 and/or rear door 122 for a predetermined gradation based on the machine characteristics selected by the operator in, for example, step 704. It is contemplated that in some exemplary embodiments, controller 152 may execute one or more machine learning models stored in memory device 156 to determine the position of front door 98 and/or rear door 122 based on a predetermined gradation specified by an operator. It is also contemplated that the one or more machine learning models may be updated by receiving updated models from an offboard control system via communications interface 168 and storing the updated models in memory device 156.

Method 700 may include a step of selectively adjusting a actuator 108, 132 associated with front door 98 and/or rear door 122, respectively, (Step 708). In step 708, controller 152 may determine an amount of actuation of actuator 108 and/or 132 required to locate front door 98 and/or rear door 122, respectively, at the positions determined in, for example, step 706. For example, when actuators 108 and/or 132 are piston-cylinder type actuators, controller 152 may determine a volume or flow rate of hydraulic fluid or air that must be allowed to flow into or out of actuators 108 and/or 132 to move front door 98 and/or rear door 122, respectively, to the positions determined in, for example, step 706. By way of another example, when actuators 108 and/or 132 are rotational actuators, controller 152 may determine an angle by which actuators 108 and/or 132 must be rotated to move front door 98 and/or rear door 122, respectively, to the positions determined in, for example, step 706. Controller 152 may also transmit one or more signals to the appropriate control devices such as pumps, valves, solenoids, motors, etc. to cause actuators 108 and/or 132 to extend, retract, or rotate to position front door 98 and/or rear door 122, respectively, at the positions determined in, for example, step 706.

When initiating reclaimer operations, step 708 may also include operating reclaimer 10, 80 using the one or more machine characteristics, and/or positions of front door 98 and/or rear door 122. For example, step 708 may include adjusting a height of frame 12 to a desired height above ground surface 30 for reclaimer 10 or adjusting a height of drum chamber 50 to a desired height above ground surface 30 for reclaimers 10, 80, engaging appropriate devices such as pumps, clutches, etc. to allow milling drum 44 to rotate at the desired rotational speed of the drum, and propelling one or more of propulsion devices 18, 20, 22, 24 so that reclaimer 10, 80 begins moving in the milling direction. In addition, step 708 may include adjusting a height of milling drum 44 relative to frame 12, 82 so that teeth 48 of milling drum 44 engage with and remove material from ground surface 30 and accumulate the removed material in drum chamber 50. Operating reclaimer 10, 80 in step 708 may also include supplying the stabilizing materials into drum chamber 50 and mixing the material removed from ground surface 30 by milling drum 44 with the stabilizing materials. Further, operating reclaimer 10, 80 in step 708 may include propelling reclaimer 10, 80 in a forward or rearward direction so that material from drum chamber 50 may exit from under rear door 122 or front door 98, respectively.

Method 700 may include a step of determining a current position of front door 98 and/or rear door 122 (Step 710). In step 710, controller 152 may receive signals from position sensors 120 and 140 indicating a current position of front door 98 and rear door 122, respectively. Controller 152 may also receive signals from height sensors 40 of reclaimer 10, indicating a current height of frame 12 above ground surface 30. It will be understood that for reclaimer 80, controller 152 may receive a height of frame 82 above ground surface 30 from memory device 156. Controller 152 may additionally or alternatively receive signals from height sensors 40 associated with drum chamber 50, indicating a current height of drum chamber 50 relative to ground surface 30. Further, controller 152 may receive signals from one or more drum position sensors 162 indicating a current position of milling drum 44 relative to frame 12, 82. In some exemplary embodiments, controller 152 may determine a current height of lower edge 104 and/or lower edge 128 of front door 98 and/or rear door 122, respectively, based on the signals received from positions sensors 120, 140, height sensors 40 (or height of frame 82), and drum position sensor 162.

Method 700 may include a step of determining one or more current machine characteristics of reclaimer 10, 80

(Step 712). For example, in step 712, controller 152 may receive signals from one or more of ground height sensors 40, position sensors 120, 140, 162, ground speed sensors 164, drum speed sensor 166, and one or more of temperature sensors, pressure sensors, flow-rate sensors, or other sensors associated with reclaimer 10, 80. Controller 152 may determine a height of frame 12 relative to ground surface 30 for reclaimer 10, a position of milling drum 44 (e.g. height of milling drum 44 relative to frame 12, 82), height of drum chamber 50 above ground surface 30, ground speed of reclaimer 10, 80, rotational speed of milling drum 44, engine speed, engine torque, rate of fuel consumption, amount of power generated by engine 56, acceleration or deceleration of reclaimer 10, 80, and/or other parameters associated with operation of reclaimer 10, 80.

Method 700 may include a step of determining whether any of the positions of front door 98 and rear door 122, and/or any of the machine characteristics determined in, for example, step 712 are different from machine characteristics at a prior time (e.g. determined in steps 704 and/or 706). When controller 152 determines that one or more of the positions of front door 98 and rear door 122, and/or any of the machine characteristics have changed by more than predetermined thresholds (Step 714: YES), controller 152 may return to step 706. It is contemplated that in some exemplary embodiments, controller 152 may proceed to step 706 when any one of the positions of front door 98 and rear door 122, and/or the machine characteristics has changed by more than a respective predetermined threshold. In other exemplary embodiments, controller 152 may return to step 706 when a selected set of positions of front door 98 and rear door 122, and/or the machine characteristics has changed by more than a respective predetermined threshold. Controller 152 may perform operations similar to those discussed above for step 706 with the following modifications. Instead of using the initial machine characteristics selected by the operator, controller 152 may determine the position of front door 98 and/or rear door 122 based on the one or more input parameters (e.g. predetermined position or predetermined gradation) provided in, for example, step 702; the current positions of front door 98 and/or rear door 122 obtained from, for example, step 710; and one or more of the current machine characteristics determined in, for example, step 712. Controller may also perform steps 706 through 714.

Returning to step 714, when controller 152 determines, however, that the positions of front door 98 and rear door 122, and/or machine characteristics have not changed by more than predetermined thresholds (Step 714: NO), controller 152 may return to step 710 and perform steps 710-714. Controller 152 may stop performing method 700 when reclaimer operations are completed, for example, when reclaimer 10, 80 is turned off, stopped, or when milling drum 44 is raised out of contact with ground surface 30.

It will be apparent to those skilled in the art that various modifications and variations can be made to the disclosed reclaimer with drum chamber control. Other embodiments will be apparent to those skilled in the art from consideration of the specification and practice of the disclosed reclaimer having drum chamber control. It is intended that the specification and examples be considered as exemplary only, with a true scope being indicated by the following claims and their equivalents.

What is claimed is:

1. A reclaimer, comprising:
a frame;
a plurality of wheels connected to the frame;
a drum chamber connected to the frame, the drum chamber extending along a width of the frame;
a movable door attached to the drum chamber and extending along the width of the frame;
a milling drum positioned within the drum chamber and configured to engage with a ground surface;
an engine configured to rotate the milling drum and propel the wheels such that material exits the drum chamber from under the movable door; and
a controller configured to:
determine a target position of the movable door based on a machine characteristic and a predetermined gradation for the material exiting from the drum chamber; and
selectively adjust an actuator associated with the movable door based on the determined target position.

2. The reclaimer of claim 1, further including:
at least one height sensor configured to determine a height of the frame relative to the ground surface; and
a drum position sensor configured to determine a position of the milling drum,
wherein the machine characteristic includes at least one of the height of the frame and the position of the milling drum.

3. The reclaimer of claim 2, wherein the at least one height sensor is one of a sonic sensor, a laser sensor, a contact sensor, or a global positioning system sensor.

4. The reclaimer of claim 2, wherein the at least one height sensor includes:
a first height sensor attached to one side of the frame; and
a second height sensor attached to an opposite side of the frame along the width of the frame.

5. The reclaimer of claim 2, further including:
a ground speed sensor configured to determine a ground speed of the reclaimer,
wherein the machine characteristic includes the ground speed and the controller is configured to determine the target position based on the ground speed and the predetermined gradation.

6. The reclaimer of claim 2, further including a plurality of legs disposed between the frame and the wheels, each of the wheels being connected to the frame by one of the legs, wherein at least one of the legs is height adjustable.

7. The reclaimer of claim 1, further including:
an input device configured to receive an input indicating a predetermined height of the door from the ground surface,
wherein the controller is configured to determine the position of the movable door based on the predetermined height.

8. The reclaimer of claim 1, wherein
the movable door is a rear door,
the position of the movable door is a first position,
the drum chamber includes a front door disposed opposite the rear door and extending along the width of the frame, and
the controller is further configured to:
determine a second position of the front door based on at least one of the machine characteristic and the predetermined gradation; and
selectively adjust an actuator associated with the front door based on the determined second position.

9. The reclaimer of claim 1, further including:
a pair of arms pivotably connected to opposite sides of the frame along the width of the frame;
a cross tube connecting the pair of arms;

the milling drum rotatably connected to free ends of the pair of arms; and at least one arm actuator connected at one end to the frame and at an opposite end to the cross tube.

10. The reclaimer of claim 9, further including a drum position sensor configured to measure a position of the at least one arm actuator.

11. The reclaimer of claim 1, wherein the drum chamber is fixedly attached to the frame.

12. The reclaimer of claim 1, wherein the drum chamber is movable relative to the frame.

13. A method of operating a reclaimer having a frame supported by a plurality of wheels connected to the frame by a plurality of legs, a milling drum attached to the frame, and a drum chamber surrounding the milling drum, the method comprising:

adjusting a height of the milling drum relative to the frame;

rotating the milling drum to cut a ground surface;

accumulating and mixing material cut by the milling drum in the drum chamber;

propelling the wheels and allowing the material to exit the drum chamber from under a movable door of the drum chamber;

determining, using a controller, a target position of the movable door based on a machine characteristic and a predetermined gradation of the material exiting from the drum chamber; and selectively adjusting an actuator associated with the movable door based on the determined target position.

14. The method of claim 13, further including receiving, using an input device, an input specifying the predetermined gradation.

15. The method of claim 13, wherein the plurality of legs are height adjustable, and the method further includes:

operating at least one of the legs to adjust a height of the frame relative to the ground surface;

determining, using at least one height sensor, a height of the frame relative to the ground surface;

determining, using a drum position sensor, a position of the milling drum relative to the frame; and wherein the machine characteristic includes at least one of the height and the position of the milling drum.

16. The method of claim 15, further including:

receiving, using an input device, an input indicating a predetermined distance between the movable door and the ground surface;

determining, using the at least one height sensor, a height of the frame relative to the ground surface, wherein the machine characteristic includes the height.

17. The method of claim 13, further including:

determining, using the controller, an engine characteristic including at least one of an engine speed, an engine torque, a rate of fuel consumption, or an amount of power generated by an engine, wherein the machine characteristic includes the engine characteristic.

18. A reclaimer, comprising:

a frame;

a left front wheel disposed connected to a front end of the frame;

a right front wheel disposed connected to the front end and spaced apart from the left front wheel;

a left rear wheel disposed connected to a rear end of the frame;

a right rear wheel disposed connected to the rear end and spaced apart from the left rear wheel;

a left arm pivotably connected to the frame and extending from the frame;

a right arm pivotably connected to the frame and extending from the frame;

a cross tube connecting the left arm and the right arm;

at least one arm actuator connecting the frame and the cross tube;

a milling drum rotatably connected to free ends of the left and right arms;

a drum chamber configured to enclose the milling drum, the drum chamber extending along a width of the frame;

a movable rear door attached to the drum chamber and extending along the width of the frame;

a movable front door attached to the drum chamber and extending along the width of the frame;

an engine configured to rotate the milling drum and propel the wheels such that material exits the drum chamber from under the rear door; and a controller configured to:

determine a target position of at least one of the rear door and the front door based on a machine characteristic and a predetermined gradation for the material exiting from the drum chamber; and selectively adjust an actuator associated with at least one of the rear door and the front door based on the determined target position.

19. The reclaimer of claim 18, further including:

a left front leg connecting the frame and the left front wheel;

a right front leg connecting the frame and the right front wheel;

a left rear leg connecting the frame and the left rear wheel; and a right rear leg connecting the frame the right rear wheel, wherein one or more of the left front leg, the right front leg, the left rear leg, and the right rear leg is height adjustable, and the drum chamber is fixedly attached to the frame.

20. The reclaimer of claim 18, wherein the drum chamber is movable relative to the frame.

* * * * *